US008758059B2

(12) United States Patent
Watanabe et al.

(10) Patent No.: US 8,758,059 B2
(45) Date of Patent: Jun. 24, 2014

(54) CABLE COUPLING CONNECTOR

(75) Inventors: Yosuke Watanabe, Tokyo (JP); Yuichi Sasaki, Tokyo (JP); Chiharu Miyazaki, Tokyo (JP); Naoto Oka, Tokyo (JP); Koichiro Misu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 167 days.

(21) Appl. No.: 13/520,684

(22) PCT Filed: Dec. 28, 2010

(86) PCT No.: PCT/JP2010/007605

§ 371 (c)(1),
(2), (4) Date: Aug. 20, 2012

(87) PCT Pub. No.: WO2011/083560

PCT Pub. Date: Jul. 14, 2011

(65) Prior Publication Data

US 2012/0309230 A1 Dec. 6, 2012

(30) Foreign Application Priority Data

Jan. 5, 2010 (JP) ..... 2010-000524

(51) Int. Cl.
*H01R 13/66* (2006.01)

(52) U.S. Cl.
USPC ..... 439/620.03; 439/620.09

(58) Field of Classification Search
USPC ..... 439/620.03, 620.05, 620.09, 439/620.13–620.14, 620.21, 578
See application file for complete search history.

(56) References Cited

U.S. PATENT DOCUMENTS 4,389,625 A * 6/1983 Sladek et al. ..... 333/260
4,553,806 A 11/1985 Forney, Jr. et al.
4,910,479 A * 3/1990 Fuji et al. ..... 333/260
4,934,960 A * 6/1990 Capp et al. ..... 439/620.09
5,032,091 A 7/1991 Itzkoff (Continued)

FOREIGN PATENT DOCUMENTS

JP 57 167581 10/1982
JP 59 230274 12/1984

(Continued)

OTHER PUBLICATIONS

International Search Report Issued Mar. 22, 2011 in PCT/JP10/07605 Filed Dec. 28, 2010.

*Primary Examiner* — Xuong Chung Trans
(74) *Attorney, Agent, or Firm* — Oblon, Spivak, McClelland, Maier & Neustadt, L.L.P.

(57) ABSTRACT

A cable coupler including an external cylinder mechanism having an inner conductor for electrically connecting the inner conductor itself to the outer conductors of the shielded cables, an outer conductor having a larger diameter than the inner conductor, a gap portion disposed between the inner conductor and the outer conductor, and capacitors arranged in the gap portion, for electrically connecting between the outer conductor and the inner conductor, an inner portion of the external cylinder mechanism being able to be opened and closed along a longitudinal direction, an internal coupling mechanism placed inside the inner conductor and having connecting pins for holding the core wires of the shielded cables, for electrically connecting between the core wires of the shielded cables, and a base for holding the external cylinder mechanism and for electrically connecting the external cylinder mechanism to an external conductor.

18 Claims, 11 Drawing Sheets

(56) References Cited

U.S. PATENT DOCUMENTS

| | | | | |
|---|---|---|---|---|
| 5,172,299 | A | 12/1992 | Yamada et al. | |
| 5,796,315 | A * | 8/1998 | Gordon et al. | 333/24 C |
| 7,749,026 | B1 * | 7/2010 | Li et al. | 439/620.03 |
| 8,174,132 | B2 * | 5/2012 | Van Swearingen | 257/798 |
| 2002/0182934 | A1 | 12/2002 | Endo et al. | |
| 2008/0310075 | A1 | 12/2008 | Takeoka et al. | |

FOREIGN PATENT DOCUMENTS

| | | |
|---|---|---|
| JP | 61 260616 | 11/1986 |
| JP | 61 194280 | 12/1986 |
| JP | 2 11398 | 1/1990 |
| JP | 2 14784 | 1/1990 |
| JP | 2 130000 | 5/1990 |
| JP | 4 6762 | 1/1992 |
| JP | 4 10406 | 1/1992 |
| JP | 4 233178 | 8/1992 |
| JP | 6 36247 | 5/1994 |
| JP | 8 106959 | 4/1996 |
| JP | 8 195246 | 7/1996 |
| JP | 3089093 | 10/2002 |
| JP | 2002 352925 | 12/2002 |
| JP | 2004 146196 | 5/2004 |
| JP | 2005 175027 | 6/2005 |
| JP | 2007 49547 | 2/2007 |
| JP | 2007 81007 | 3/2007 |
| JP | 2007 157525 | 6/2007 |
| JP | 2007 172863 | 7/2007 |
| JP | 2008 177015 | 7/2008 |
| JP | 2009 135768 | 6/2009 |

* cited by examiner

CABLE COUPLING CONNECTOR

FIELD OF THE INVENTION

The present invention relates to a cable coupling connector as a coupler which suppresses the transmission of an electromagnetism noise piggybacked onto a shielded cable.

BACKGROUND OF THE INVENTION

A communication system located in an electromagnetism noisy environment is isolated electromagnetically from the environment exterior to the communication system by using shielded cables, and electromagnetic interference emissions from cables are suppressed in the communication system. A shielded cable is comprised of an inner conducting wire, an outer conductor for shield (an outer conductor sheath), and a holding resin. The inner conducting wire is connected to a signal system and the outer conductor sheath is connected to a ground in such a way that a shielding structure in which the internal signal system is enclosed by the ground is formed.

However, in many cases, equipment for use in a heavy current system which handles large electric power is constructed in such a way that a ground which is a return circuit for a large current and a ground for conductor wires in a weak electric current system are separated from each other from the viewpoint of electrical safety, and the grounds are provided as systems which are separated from each other. For example, a metal housing or the like which is aground for a return circuit in a heavy current system is defined as a frame ground (FG), and a ground for a signal system connected to an outer conductor of a shielded cable is defined as a signal ground (SG). Because these FG system and SG system are separated from each other, when an electromagnetism noise is piggybacked onto SG, there is a possibility that the noise propagates through the outer conductor of the shielded cable and affects various pieces of equipment. Therefore, although it is necessary to connect the SG system to the FG system to bypass the electromagnetism noise, the SG system cannot be connected directly to the FG system from problems about electrical safety.

To solve this problem, a structure in which no conduction from an SG system to an FG system is provided, but only an electromagnetism noise occurring in the SG system is bypassed is disclosed. For example, according to patent reference 1, a dielectric substance is disposed around a BNC type plug (a connector), and metallic mounting hardware is disposed around the dielectric substance. Further, according to, for example, patent reference 2, a plate capacitor is disposed between a frame and the locknuts of a connector. In addition, according to, for example, patent reference 3, a structure in which an O ring, which is conventionally inserted between a locknut and a chassis, is replaced by a filtering device (a capacitor), such as a capacitor, is disclosed. The outer conductor of a connector is electrically connected to a frame via the filtering device. In addition, according to, for example, patent reference 4, the outer conductor of a connector is electrically connected to a frame via a capacitor and a resistor. In addition, according to, for example, patent reference 5, a connector for a coaxial cable having multiple outer conductors is constructed in such a way that an inside outer conductor and an outside outer conductor are terminated respectively.

RELATED ART DOCUMENT

Patent Reference

Patent reference 1: Japanese Unexamined Utility Model (Registration) Application Publication No. Hei 02-014784

Patent reference 2: Japanese Unexamined Utility Model (Registration) Application Publication No. Hei 02-011398

Patent reference 3: Japanese Unexamined Patent Application Publication No. Hei 04-233178

Patent reference 4: Japanese Unexamined Utility Model (Registration) Application Publication No. Sho 61-194280

Patent reference 5: Japanese Unexamined Patent Application Publication No. Sho 59-230274

SUMMARY OF THE INVENTION

Problems to be Solved by the Invention

A problem is, however, that the structures disclosed by above-mentioned patent references 1 and 2 are intended for connection of only a specific type of shielded cable, and cannot support various types of shielded cables. Further, a problem with the structures disclosed by patent references 1, 3, and 4 is that they are intended for a connection of an SG system with an FG system at a specific position, and cannot support any connection of an SG system with an FG system at an arbitrary position on a shielded cable.

A further problem with the structures disclosed by above-mentioned patent references 2 and 3 is that the plate capacitor is damaged when no management of the torque of the locknut is provided. A still further problem with the structure disclosed by patent reference 2 is that an adequate contact cannot be achieved depending on the surface roughness of the locknut, the frame, and the connector, and no shielding effect is produced. A still further problem with the structure disclosed by above-mentioned patent reference 5 is that two conductors are simply connected to each other and no effect of suppressing noise propagation is produced.

The present invention is made in order to solve the above-mentioned problems, it is therefore an object of the present invention to provide a cable coupling connector which can couple two shielded cables included in various types of shielded cables at an arbitrary position on the two shielded cables while being compliant with the shielded cables, and which serves as a coupler for equivalently connecting an SG system to an FG system with respect to an electromagnetism noise.

Means for Solving the Problem

In accordance with the present invention, there is provided a cable coupling connector including: an external cylinder mechanism having an inner conductor electrically connected to outer conductors of shielded cables throughout entire perimeters of the outer conductors and having a space formed therein, an outer conductor formed outside the inner conductor, and a capacitive member placed in a gap portion between the inner conductor and the outer conductor and having a property of electrically insulating the outer conductor and the inner conductor from each other with respect to a direct current, and electrically connecting between the outer conductor and the inner conductor with respect to an alternating current, the external cylinder mechanism being formed in such a way that an inner portion of the external cylinder mechanism can be opened and closed along a longitudinal direction of the inner conductor and the outer conductor; an internal coupling mechanism having an isolator placed in the space of the inner conductor of the external cylinder mechanism, and connecting pins held by the isolator and electrically connecting between core wires of the shielded cables; and a base for holding the external cylinder mechanism and for electrically connecting the external cylinder mechanism to an external conductor.

Further, the cable coupling connector in accordance with the present invention has conductors respectively placed on inner walls of the inner conductor of the external cylinder mechanism, the inner walls being respectively opposite to the outer conductors of the shielded cables, for pressing down the outer conductors of the above-mentioned shielded cables, in addition to the above-mentioned structure.

In addition, the cable coupling connector in accordance with the present invention has either an inductive member or a combination of a capacitive member and an inductive member placed as the capacitive member in the gap portion of the external cylinder mechanism, in addition to the above-mentioned structure.

Advantages of the Invention

Because the cable coupler according to the present invention is constructed as above, the cable coupler can connect between two shielded cables included in various types of shielded cables, and can equivalently connect an SG system to an FG system at an arbitrary position on shielded cables with respect to an electromagnetism noise. As a result, there is provided an advantage of being able to suppress the propagation of an electromagnetism noise piggybacked onto the outer conductors for shield of the shielded cables.

EMBODIMENTS OF THE INVENTION

Hereafter, the preferred embodiments of the present invention will be explained in detail with reference to the drawings.

Embodiment 10

Figure 1:
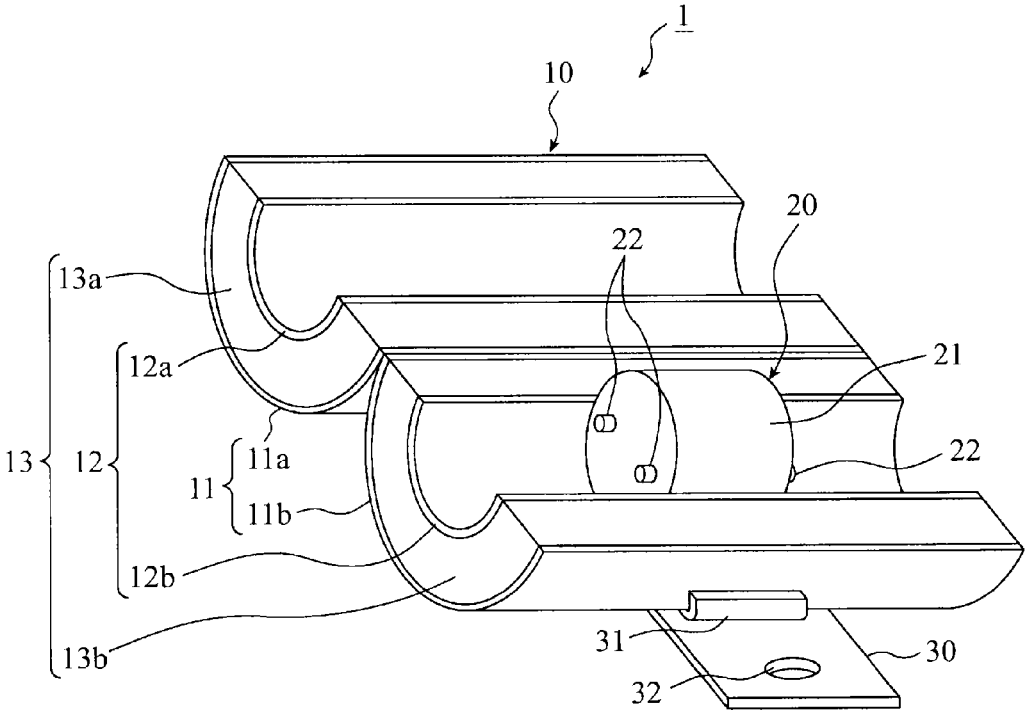
FIG. 1 is a view showing the structure of a cable coupler in accordance with Embodiment 1 of the present invention.

FIG. 1 shows the structure of a cable coupler 1 in accordance with Embodiment 1. As shown in FIG. 1, the cable coupler 1 is comprised of an external cylinder mechanism 10, an internal coupling mechanism 20, and a base 30, and functions as a cable coupling connector. The external cylinder mechanism 10 houses the internal coupling mechanism 20 therein and is also placed on and fixed to the base 30, and the base 30 is fixed to a housing (an external conductor) of not-shown electronic equipment.

In the external cylinder mechanism 10, a cylindrical-shaped outer conductor 11 is combined with a cylindrical-shaped inner conductor 12 in such a way that the outer conductor 11 is formed outside the inner conductor 12, the outer conductor 11 has a larger diameter than the inner conductor 12, and a gap portion 13 is formed between the outer conductor 11 and the inner conductor 12, as shown in FIG. 1. Further, as shown in FIG. 1, the external cylinder mechanism 10 is formed in such a way that an inner portion of the external cylinder mechanism can be opened and closed along a longitudinal direction of the outer conductor 11 and the inner conductor 12.

The outer conductor 11 is comprised of an opening and closing mechanism in which a part of the perimeter of an upper outer conductor 11*a* is connected to a part of the perimeter of a lower outer conductor 11*b* in such a way that the parts can hinge, and each of the upper and lower outer conductors 11*a* and 11*b* is formed into a semi-cylindrical shape. Further, the outer conductor 11 is in contact with the conductive base 30, and is electrically connected to the base 30.

The inner conductor 12 has a cylindrical-shaped space formed therein, and functions as a mechanism of allowing the ends of shielded cables, which will be mentioned below, to be respectively inserted thereinto from both ends thereof, and electrically connecting the outer conductors for shield of the shielded cables, which will be mentioned below, thereto. Further, the inner conductor 12 is comprised of an upper inner conductor 12*a* and a lower inner conductor 12*b*, and each of the upper and lower inner conductors 12*a* and 12*b* is formed into a semi-cylindrical shape.

Capacitors (capacitive members), which will be mentioned below, are arranged in the gap portion 13, and electrically connect between the outer conductor 11 and the inner conductor 12. An upper gap portion 13*a* is formed between the upper outer conductor 11*a* and the upper inner conductor 12*a*, and a lower gap portion 13*b* is formed between the lower outer conductor 11*b* and the lower inner conductor 12*b*.

Because the external cylinder mechanism 10 is constructed in this way, the external cylinder mechanism 10 functions as a mechanism of grounding the outer conductor for shield of a shielded cable, which will be mentioned below, to the housing of not shown electronic equipment via the inner conductor 12, the capacitors which will be mentioned later, the outer conductor 11, and the base 30 to cause an electromagnetism noise piggybacked onto the outer conductor for shield to flow to the housing. The external appearance of the external cylinder mechanism 10 will be mentioned below.

The internal coupling mechanism 20 is placed in the inner space of the inner conductor 12, as shown in FIG. 1, and holds and fixes connecting pins 22 in the inner space with a columnar resin material 21. Each of the connecting pins 22 consists of a cylindrical-shaped conductor, and extends in the longitudinal direction of the external cylinder mechanism 10. The connecting pins 22 are constructed in such a way as to fix and hold the core wires of shielded cables which are inserted into the inner space of the inner conductor from both the ends of the external cylinder mechanism 10 in the longitudinal direction of the external cylinder mechanism, respectively, as will be mentioned below, to electrically connect between the core wires of the shielded cables. The resin material 21 can consist of an isolator for fixing the connecting pins 22.

The base 30 consists of a conductor, and has a holder portion 31 and a screw hole 32, as shown in FIG. 1. The holder portion 31 holds and fixes the external cylinder mechanism 10, and the screw hole 32 is used for fixing the base 30 to the housing of the not-shown electronic equipment with a screw.

Figure 2:
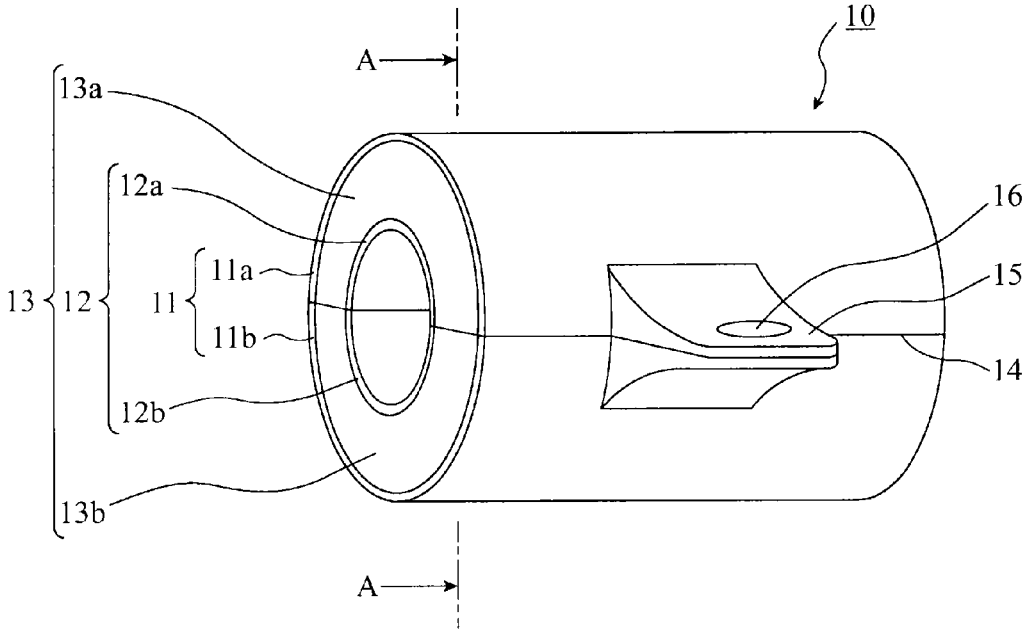
FIG. 2 is a view showing the external appearance of an external cylinder mechanism of the cable coupler in accordance with Embodiment 1 of the present invention.

The external appearance of the external cylinder mechanism 10 will be explained with reference to FIG. 2. The external cylinder mechanism 10 is provided with fixing stoppers 15 which enable the upper outer conductor 11*a* and the lower outer conductor 11*b* to be in contact with each other and closed at a cut 14, as shown in FIG. 2, and a screw hole 16 is formed in the fixing stoppers 15. A not-shown screw is screw into the screw hole 16 in such a way that the upper outer conductor 11*a* is brought into contact with the lower outer conductor 11*b*, and these outer conductors are closed.

Figure 3:
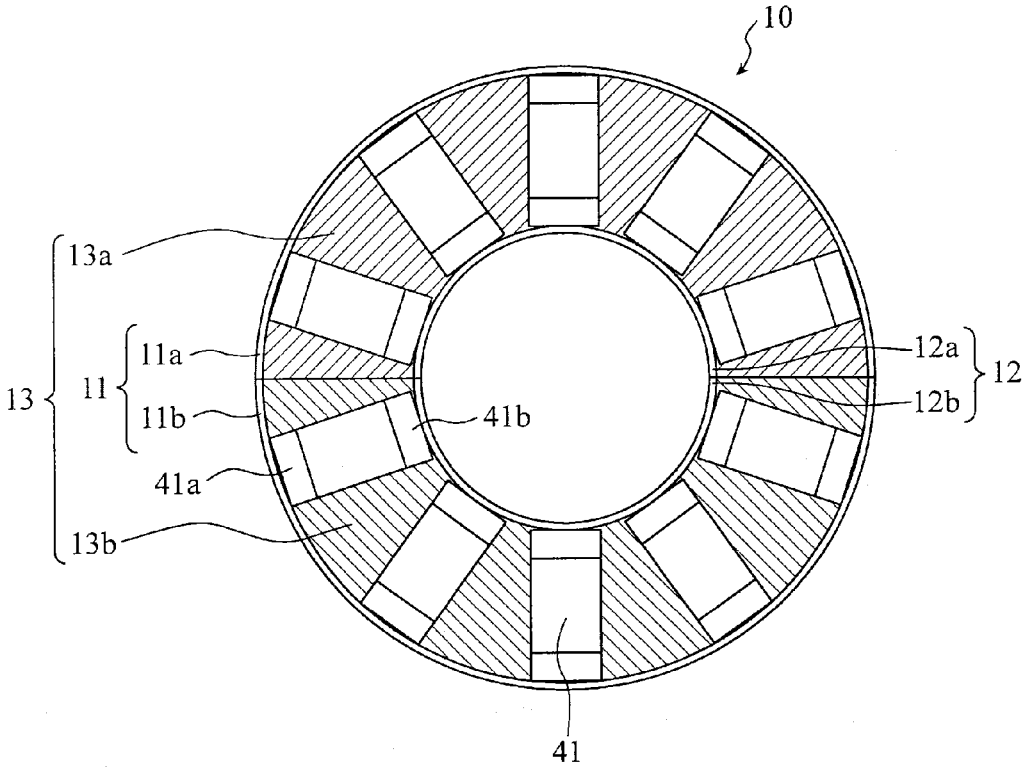
FIG. 3 is a view showing a cross section of the external cylinder mechanism of the cable coupler in accordance with Embodiment 1 of the present invention.

FIG. 3 shows a cross section taken along the A-A line of the external cylinder mechanism 10 of FIG. 2. The external cylinder mechanism 10 includes the capacitors 41 each having an electrode 41*a* and an electrode 41*b* and arranged in the gap portion 13 between the outer conductor 11 and the inner conductor 12, as shown in FIG. 3. The electrode 41*a* is in contact with the outer conductor 11, and is fixed to the outer conductor 11 with a solder in such a way as to be electrically connected to the outer conductor. The electrode 41*b* is in contact with the inner conductor 12, and is fixed to the inner conductor 12 with a solder in such a way as to be electrically connected to the inner conductor. A part of the gap portion 13 between any two adjacent ones of the capacitors 41 is filled with a resin in such a way that each of the capacitors 41 is fixed and held. As an alternative, the gap portion 13 can be filled with a filling material other than resins. As long as the capacitors 41 are sufficiently fixed in the gap portion, the gap portion can be hollow. Further, each of the capacitors 41 can have an arbitrary size or an arbitrary capacitance which is set up properly. For example, the capacitors 41 can be chip capacitors.

Figure 4:
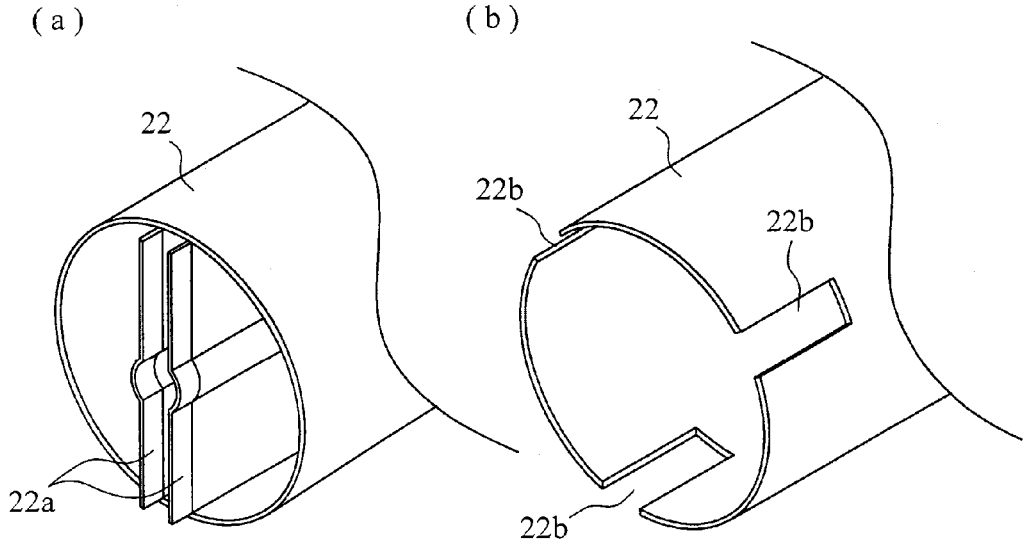
FIG. 4 is a view showing the structure of connecting pins of the cable coupler in accordance with Embodiment 1 of the present invention.

The structure of each of the connecting pins 22 of the internal coupling mechanism 20 will be explained. FIG. 4 shows an enlarged view of each of the connecting pins 22 of the internal coupling mechanism 20. Each of the connecting pins 22 has spring parts 22*a*, as shown in FIG. 4(*a*), and the spring parts 22*a* holds the core wire of a shielded cable which is inserted into the connecting pin 22 and which will be mentioned below by sandwiching the core wire therebetween. As an alternative, each of the connecting pins 22 can be constructed in such a way as to have swage parts 22*b* disposed in a portion for receiving a core wire and each shaped like a pin with split ends, as shown in FIG. 4(*b*), so that a core wire is inserted into the connecting pin 22 and the swage parts are swaged to crimp and fix the core wire thereto.

Figure 5:
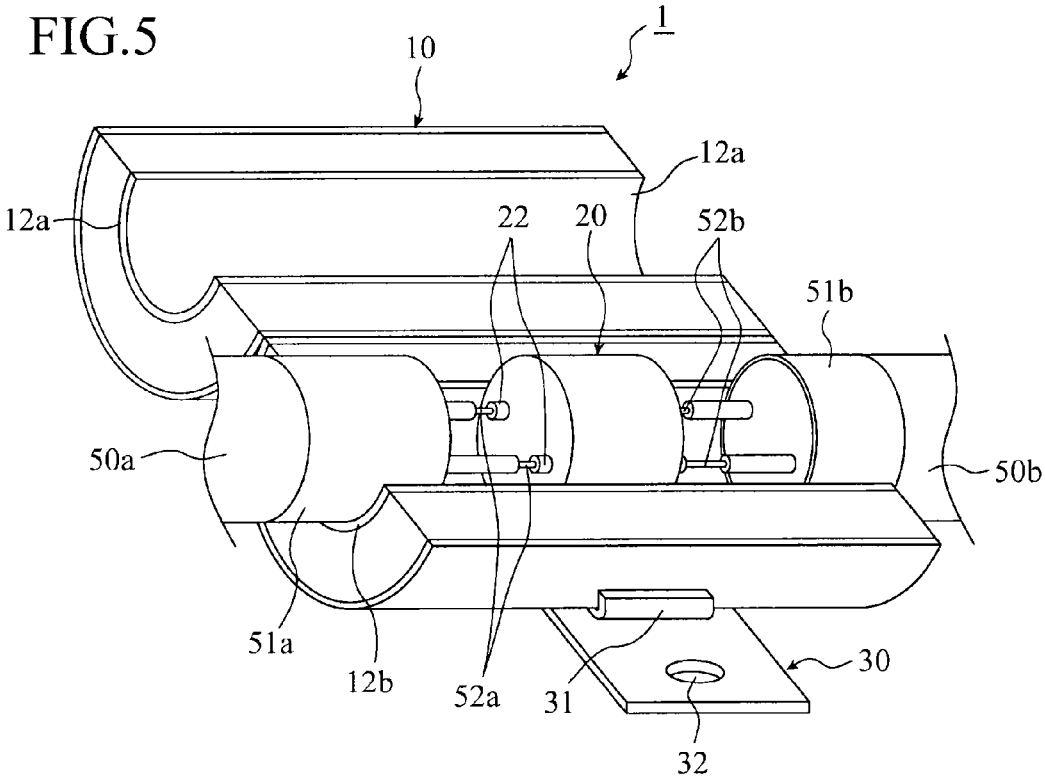
FIG. 5 is a view showing a connection method of connecting shielded cables for use in the cable coupler in accordance with Embodiment 1 of the present invention.

Next, a connection method of connecting shielded cables by using the cable coupler 1 will be explained. FIG. 5 shows a state in which shielded cables are connected to the cable coupler 1. The shielded cables 50*a* and 50*b* are processed in advance before connected to the cable coupler in such a way that their outer conductors 51*a* and 51*b* for shield and core wires 52*a* and 52*b* at ends thereof are exposed.

First, the external cylinder mechanism 10 of the cable coupler 1 is opened, and the core wires 52*a* and 52*b* of the shielded cables 50*a* and 50*b* are inserted into the connecting pins 22 of the internal coupling mechanism 20, respectively, so that the core wires are fixed to the connecting pins. Each of the outer conductors 51*a* and 51*b* for shield of the shielded cables 50*a* and 50*b* is placed in such a way as to be in contact with the lower inner conductor 12*b* of the external cylinder mechanism 10. The upper portion of the external cylinder mechanism 10 is then closed in such a way that the outer conductors 51*a* and 51*b* for shield are brought into contact with the upper inner conductor 12*a*, and a screw is screwed into the above-mentioned screw hole 16 of the fixing stoppers 15 shown in FIG. 2 so that the external cylinder mechanism is fixed. By connecting the shielded cables to the cable coupler in this way, the upper inner conductor 12*a* and the lower inner conductor 12*b* are brought contact into the outer conductors 51*a* and 51*b* for shield and are electrically connected to these outer conductors for shield.

As mentioned above, because the cable coupler 1 in accordance with Embodiment 1 includes: the external cylinder mechanism 10 having the inner conductor 12 into which the ends of the shielded cables 50*a* and 50*b* are inserted from both the ends thereof, for electrically connecting the inner conductor itself to the outer conductors 51*a* and 51*b* for shield of the shielded cables 50*a* and 50*b*, the outer conductor 11 having a larger diameter than the inner conductor 12, the gap portion 13 in which a combination of the inner conductor 12 and the outer conductor 11 is disposed, and the capacitors 41 arranged in the gap portion 13, for electrically connecting between the outer conductor 11 and the inner conductor 12, the inner portion of the external cylinder mechanism being able to be opened and closed along the longitudinal direction; the internal coupling mechanism 20 placed inside the inner conductor 12 of the external cylinder mechanism 10 and having the connecting pins 22 for holding the core wires 52*a* and 52*b* of the shielded cables 50*a* and 50*b* at both ends thereof, for electrically connecting between the core wires 52*a* and 52*b* of the shielded cables 50*a* and 50*b*; and the base 30 for holding the external cylinder mechanism 10 and for electrically connecting the external cylinder mechanism 10 to an external conductor, the cable coupler can connect between two shielded cables included in various types of shielded cables, and can equivalently connect an SG system to an FG system at an arbitrary position on shielded cables with respect to an electromagnetism noise. As a result, there is provided an advantage of being able to suppress the propagation of an electromagnetism noise piggybacked onto the outer conductors for shield of the shielded cables.

Embodiment 2

In Embodiment 1, the structure in which the capacitors 41 for electrically connecting between the outer conductor 11 and the inner conductor 12 are arranged in the gap portion 13 between the outer conductor 11 and the inner conductor 12 to suppress the propagation of an electromagnetism noise piggybacked onto the outer conductors 51*a* and 51*b* for shield of the shielded cables 50*a* and 50*b* is explained. In contrast, in Embodiment 2, a mechanism for suppressing the propagation of an electromagnetism noise piggybacked onto the outer conductors 51*a* and 51*b* for shield of shielded cables 50*a* and 50*b* by using another structure will be explained.

Figure 6:
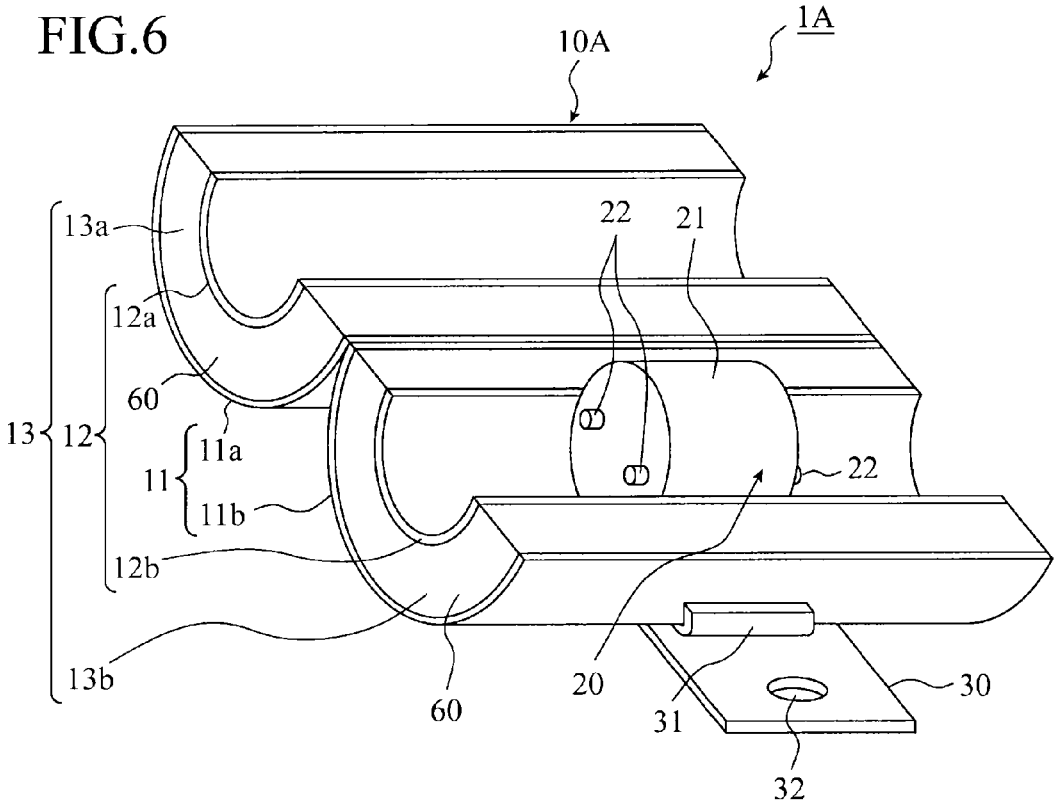
FIG. 6 is a view showing the structure of a cable coupler in accordance with Embodiment 2 of the present invention.

FIG. 6 shows the structure of a cable coupler 1A in accordance with Embodiment 2. In FIG. 6, the same components as those shown in Embodiment 1 are designated by the same reference numerals, and the explanation of the components will be omitted hereafter.

Each of an upper gap portion 13*a* and a lower gap portion 13*b* is filled with a dielectric substance 60 (a capacitive member), and this dielectric substance 60 has a function equivalent to the above-mentioned capacitors 41 shown in FIG. 3 and electrically connects between an outer conductor 11 and an inner conductor 12. By thus using the dielectric substances 60, Embodiment 2 eliminates an operation required to mount the above-mentioned capacitors 41 shown in FIG. 3 to the cable coupler.

In an external cylinder mechanism 10A, the outer conductor 11 is in contact with a conductive base 30, like in the above-mentioned embodiment shown in FIG. 5, the inner conductor 12 is in contact with the outer conductors 51*a* and 51*b* for shield of the shielded cables 50*a* and 50*b*, like in the above-mentioned embodiment shown in FIG. 5, and the inner conductor 12 and the outer conductor 11 are electrically connected to each other with the dielectric substances 60. Because the external cylinder mechanism 10 is constructed in this way, the external cylinder mechanism grounds the outer conductors 51*a* and 51*b* for shield of the above-mentioned shielded cables 50*a* and 50*b* to the housing of not shown electronic equipment via the inner conductor 12, the dielectric substances 60, the outer conductor 11, and the base 30 to cause an electromagnetism noise piggybacked onto the outer conductors for shield to flow to the housing.

Because a connection method of connecting the shielded cables by using the cable coupler 1A is the same as that in accordance with Embodiment 1, the explanation of the connection method will be omitted hereafter.

As mentioned above, while the cable coupler in accordance with Embodiment 2 provides the same advantages as those provided by that in accordance with Embodiment 1, there is provided an advantage of being able to simplify a process of assembling the cable coupler 1A because the external cylinder mechanism 10 of the cable coupler 1A has the dielectric substances 60 with which the gap portion 13 is filled and which electrically connect between the outer conductor 11 and the inner conductor 12.

Embodiment 3

Figure 7:
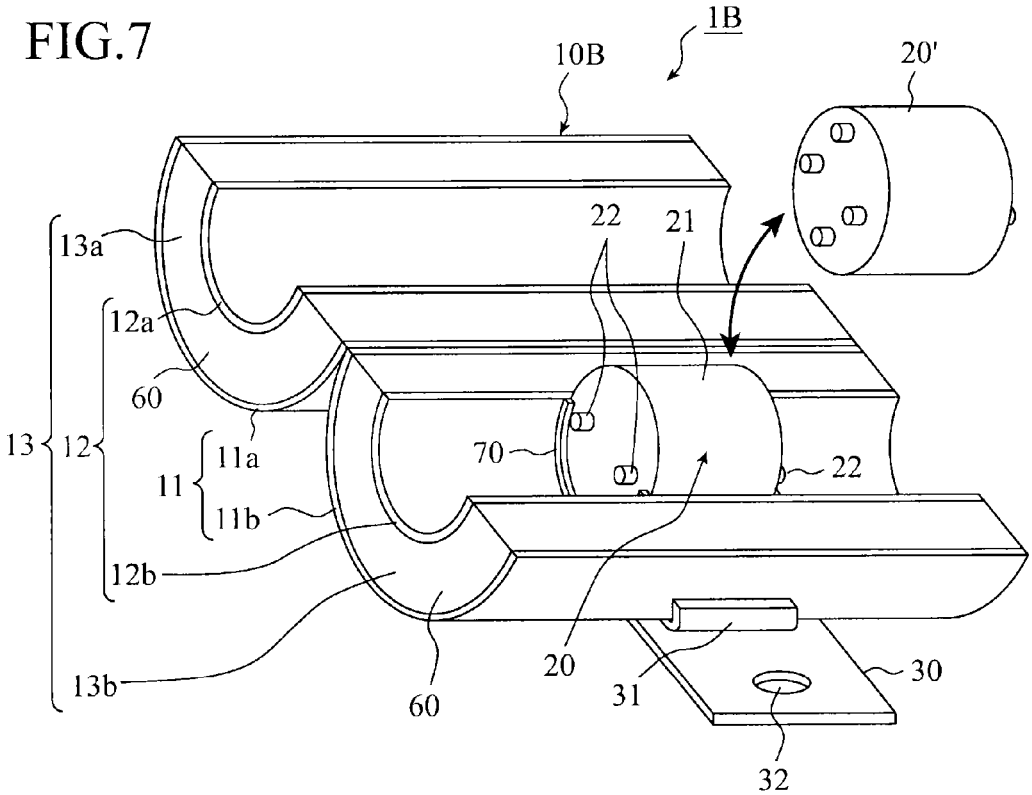
FIG. 7 is a view showing the structure of a cable coupler in accordance with Embodiment 3 of the present invention.

In Embodiment 3, a structure in which an internal coupling mechanism 20 can be replaced by another internal coupling mechanism will be explained. FIG. 7 shows the structure of a cable coupler 1B in accordance with Embodiment 3. In FIG. 7, the same components as those shown in Embodiment 2 are designated by the same reference numerals, and the explanation of the components will be omitted hereafter.

As shown in FIG. 7, the cable coupler 1B is comprised of an external cylinder mechanism 10, the internal coupling mechanism 20, and a base 30, and functions as a cable coupling connector. The external cylinder mechanism 10 houses the internal coupling mechanism 20 therein and is also placed on and fixed to the base 30, and the base 30 is fixed to a housing of not-shown electronic equipment.

In this embodiment, a guide portion 70 is disposed on an inner wall of the inner conductor 12 of the external cylinder mechanism 10, as shown in FIG. 7. The guide portion 70 is constructed in such a way as to position and fix the internal coupling mechanism 20 thereto.

For example, the internal coupling mechanism 20 is intended for two cores, and is used for a case in which the number of core wires 52*a* of the shielded cable 50*a* and the number of core wires 52*b* of the shielded cable 50*b* shown in above-mentioned FIG. 5 are two. An internal coupling mechanism 20' is constructed in such a way as to have the same size as the internal coupling mechanism 20. For example, the internal coupling mechanism 20' is intended for four cores, and is used for a case in which the number of core wires 52*a* of the shielded cable 50*a* and the number of core wires 52*b* of the shielded cable 50*b* shown in above-mentioned FIG. 5 are four. The guide portion 70 is constructed in such a way as to fit the size of these internal coupling mechanisms 20 and 20'. The cable coupler is constructed in such a way that a user can easily replace the internal coupling mechanism 20 with the other internal coupling mechanism 20' by removing the internal coupling mechanism 20 intended for two cores and attached to the guide portion 70, and then fitting the other internal coupling mechanism 20' intended for four cores to the guide portion 70.

In the cable coupler 1B, the external cylinder mechanism 10 is produced in such a way as to have one of various thicknesses according to the wire size of the shielded cables 50*a* and 50*b* shown in above-mentioned FIG. 5, and the internal coupling mechanism 20 is produced according to the number of core wires 52*a* and 52*b* of the shielded cables 50*a* and 50*b* shown in above-mentioned FIG. 5, and the type and the diameter of the core wires. The cable coupler 1B is then constructed by combining one of the various types of external cylinder mechanisms 10 and one of the various types of internal coupling mechanisms 20. Because the cable coupler 1B which is constructed in this way can support various types of shielded cables 50*a* and 50*b* to couple two shielded cables included in various types of shielded cables, the extensibility of the cable coupler 1B can be improved.

In Embodiment 3, although the structure in which a gap portion 13 is filled with dielectric substances 60 is explained, the cable coupler according this embodiment can have a structure using capacitors 41, like that in accordance with Embodiment 1.

As mentioned above, while the cable coupler 1B in accordance with Embodiment 3 provides the same advantages as those provided by those in accordance with Embodiments 1 and 2, there is provided an advantage of making it possible to easily replace the internal coupling mechanism 20 with the internal coupling mechanism 20' because the cable coupler 1B has the guide portion 70 disposed on the inner wall of the inner conductor 12 of the external cylinder mechanism 10, for positioning any one of the internal coupling mechanisms 20 and 20'.

Embodiment 4

In Embodiment 4, a structure for strengthening the electric and mechanical contact between the inner conductor 12 of the external cylinder mechanism 10 and the outer conductors 51*a* and 51*b* for shield of the shielded cables 50*a* and 50*b* in the above-mentioned embodiments will be explained with reference to FIGS. 8 to 11.

Figure 8:
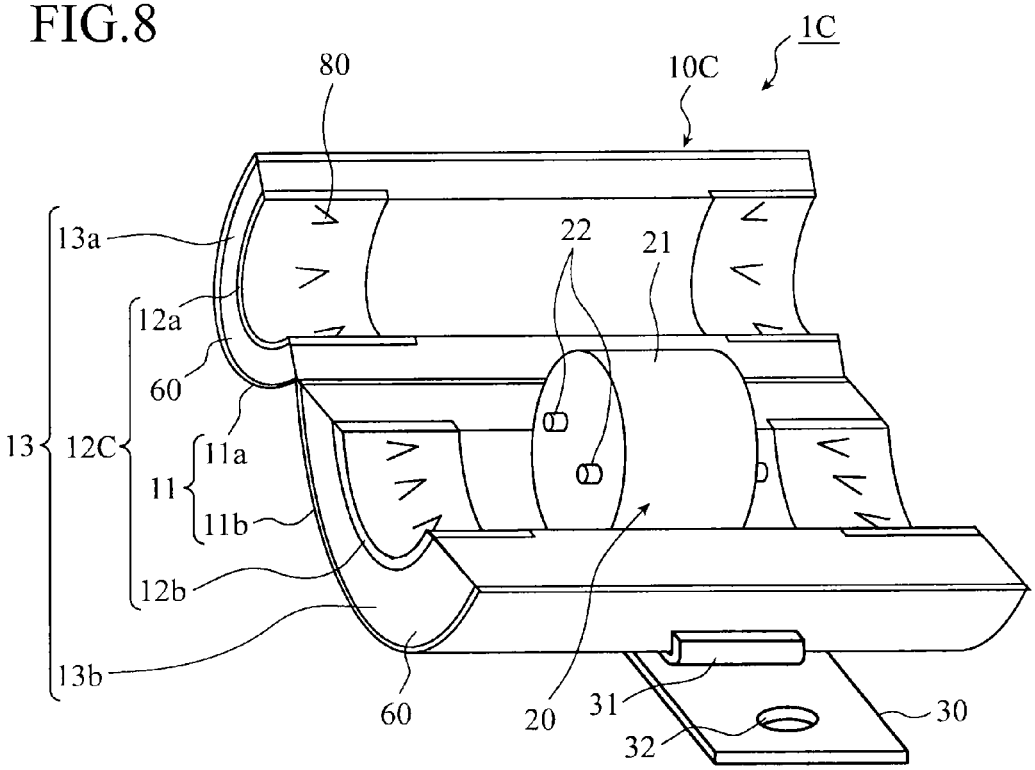
FIG. 8 is a view showing an example of the structure of a cable coupler in accordance with Embodiment 4 of the present invention.

FIG. 8 shows the structure of a cable coupler 1C in accordance with Embodiment 4. As shown in FIG. 8, the cable coupler 1C is comprised of an external cylinder mechanism 10C, an internal coupling mechanism 20, and a base 30, and functions as a cable coupling connector. Because the internal coupling mechanism 20 and the base 30 shown in FIG. 8 have the same structures as those in accordance with any one of Embodiments 1, 2, and 3, the explanation of the internal coupling mechanism 20 and the base 30 will be omitted hereafter. Further, because the structural components other than an inner conductor 12C in the external cylinder mechanism 100 are the same as those in accordance with Embodiment 2, the components are designated by the same reference numerals as those shown in FIG. 6, and the explanation of the components will be omitted hereafter.

Sawtooth-shaped engaging conductors 80 are arranged as conductors for pressing down the outer conductors 51*a* and 51*b* for shield of the shielded cables 50*a* and 50*b* shown in above-mentioned FIG. 5 on the inner conductor 12C of the external cylinder mechanism 10C. The sawtooth-shaped engaging conductors 80 are arranged at positions on the inner wall of the inner conductor 12C, particularly at positions opposite to the outer conductors 51*a* and 51*b* for shield of the shielded cables 50*a* and 50*b*, and function as a mechanism for strengthening the electric and mechanical contact between the inner wall of the inner conductor 12C and the surfaces of the outer conductors 51*a* and 51*b* for shield.

When the shielded cables 50*a* and 50*b* are mounted on the inner wall of the inner conductor 12C of the external cylinder mechanism 100, the sawtooth-shaped engaging conductors 80 are engaged in the surfaces of the outer conductors 51*a* and 51*b* for shield, so that the inner conductor presses down the shielded cables. Because the sawtooth-shaped engaging conductors 80 are engaged in the surfaces of the outer conductors 51*a* and 51*b* for shield, the cable coupler 10 certainly prevents the electric and mechanical contact between the cable coupler 1C and the shielded cables 50*a* and 50*b* from being lost due to a vibration from the routes of the shielded cables 50*a* and 50*b* and a vibration from outside the cable coupler.

Figure 9:
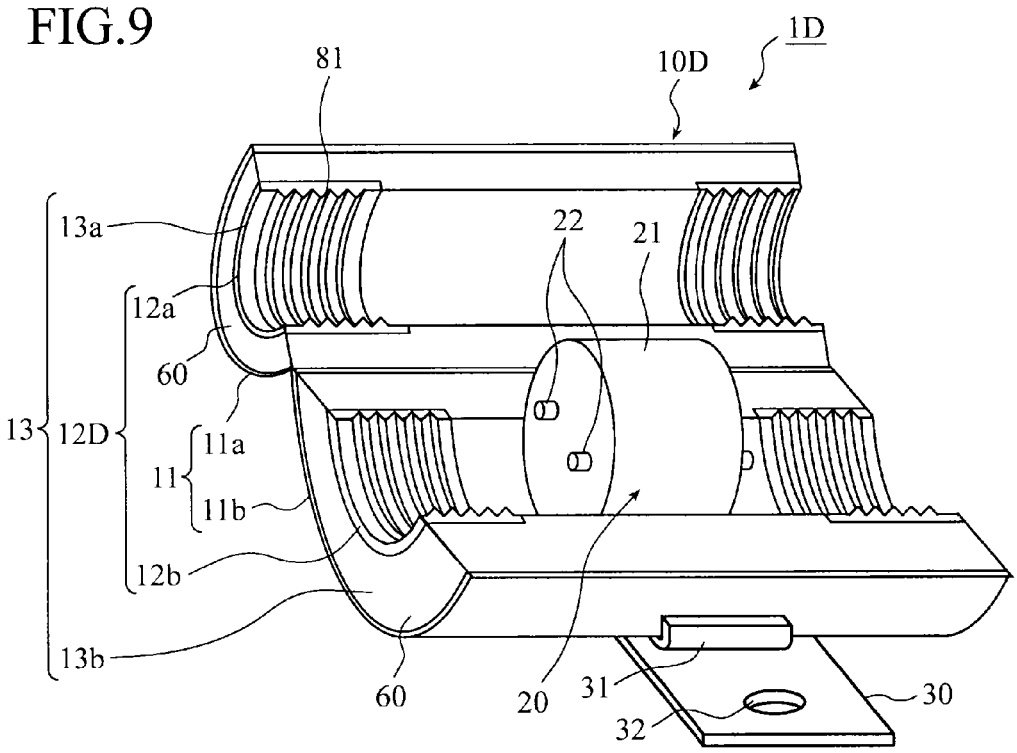
FIG. 9 is a view showing another example of the structure of the cable coupler in accordance with Embodiment 4 of the present invention.

FIG. 9 shows the structure of a cable coupler 1D in accordance with Embodiment 4. Structural components other than an inner conductor 12D in an external cylinder mechanism 10D of the cable coupler 1D are the same as those shown in FIG. 8.

The inner conductor 12D includes projecting and recessed portions 81 arranged on an inner wall thereof instead of the sawtooth-shaped engaging conductors 80 shown in FIG. 8. The projecting and recessed portions 81 are arranged at positions on the inner wall of the inner conductor 12D, particularly at positions opposite to the outer conductors 51*a* and 51*b* for shield of the shielded cables 50*a* and 50*b* (refer to FIG. 5), and include recessed portions and protruding portions which are alternately formed in the inner wall of the inner conductor 12D along a longitudinal direction (an axis direction) of the inner conductor, and function as a mechanism for strengthening the electric and mechanical contact between the inner wall of the inner conductor 12D and the surfaces of the outer conductors 51*a* and 51*b* for shield.

When the shielded cables 50*a* and 50*b* are mounted on the inner wall of the inner conductor 12D of the external cylinder mechanism 10D, the projecting and recessed portions 81 are engaged in the surfaces of the outer conductors 51*a* and 51*b* for shield, so that the inner conductor presses down the shielded cables. Because the projecting and recessed portions 81 are engaged in the surfaces of the outer conductors 51*a* and 51*b* for shield, the cable coupler 1D certainly prevents the electric and mechanical contact between the cable coupler 1D and the shielded cables 50*a* and 50*b* from being lost due to a vibration from the routes of the shielded cables 50*a* and 50*b* and a vibration from outside the cable coupler.

Figure 10:
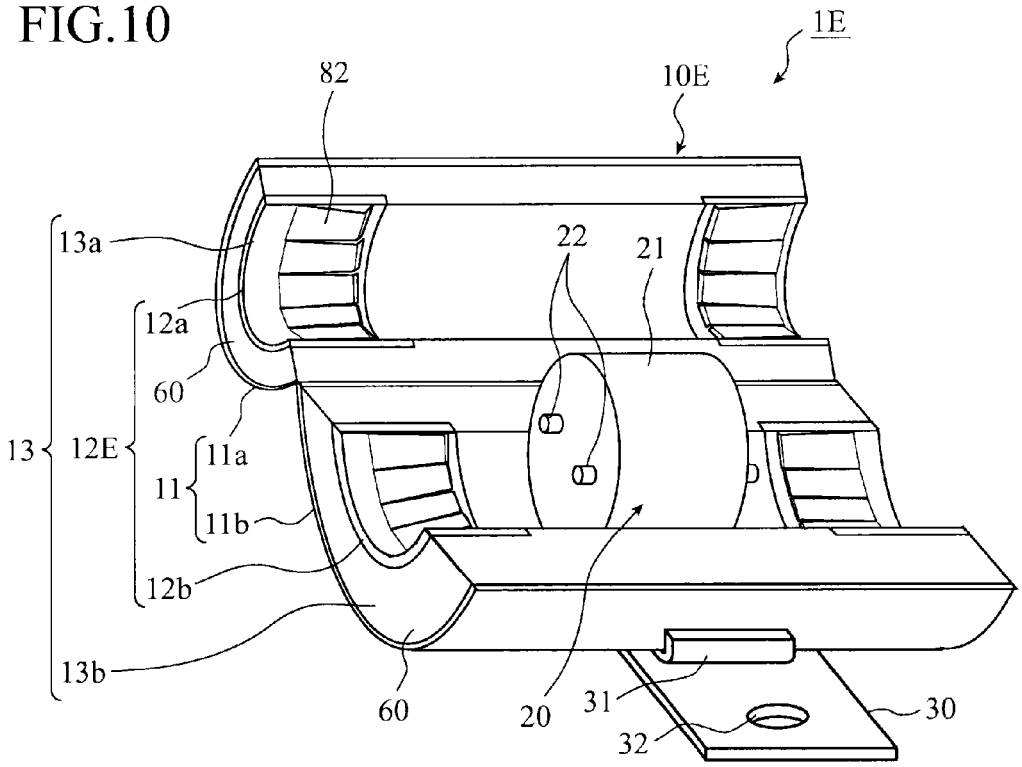
FIG. 10 is a view showing a further example of the structure of the cable coupler in accordance with Embodiment 4 of the present invention.

FIG. 10 shows the structure of a cable coupler 1E in accordance with Embodiment 4. Structural components other than an inner conductor 12E in an external cylinder mechanism 10E of the cable coupler 1E are the same as those shown in FIG. 8.

The inner conductor 12E includes flat springs 82 arranged on an inner wall thereof instead of the above-mentioned sawtooth-shaped engaging conductors 80 of the inner conductor 12C or the above-mentioned projecting and recessed portions 81 of the inner conductor 12D. The flat springs 82 are arranged at positions on the inner wall of the inner conductor 12E, particularly at positions opposite to the outer conductors 51*a* and 51*b* for shield of the shielded cables 50*a* and 50*b* (refer to FIG. 5), along a circumferential direction of the inner wall of the inner conductor, and function as a mechanism for strengthening the electric and mechanical contact between the inner wall of the inner conductor 12E and the surfaces of the outer conductors 51*a* and 51*b* for shield.

When the shielded cables 50*a* and 50*b* are mounted on the inner wall of the inner conductor 12E of the external cylinder mechanism 10E, the flat springs 82 press down the outer conductors 51*a* and 51*b* for shield by using the elastic forces thereof. Because the flat springs 82 press down the outer conductors 51*a* and 51*b* for shield, the cable coupler 1E certainly prevents the electric and mechanical contact between the cable coupler 1E and the shielded cables 50*a* and 50*b* from being lost due to a vibration from the routes of the shielded cables 50*a* and 50*b* and a vibration from outside the cable coupler.

Figure 11:
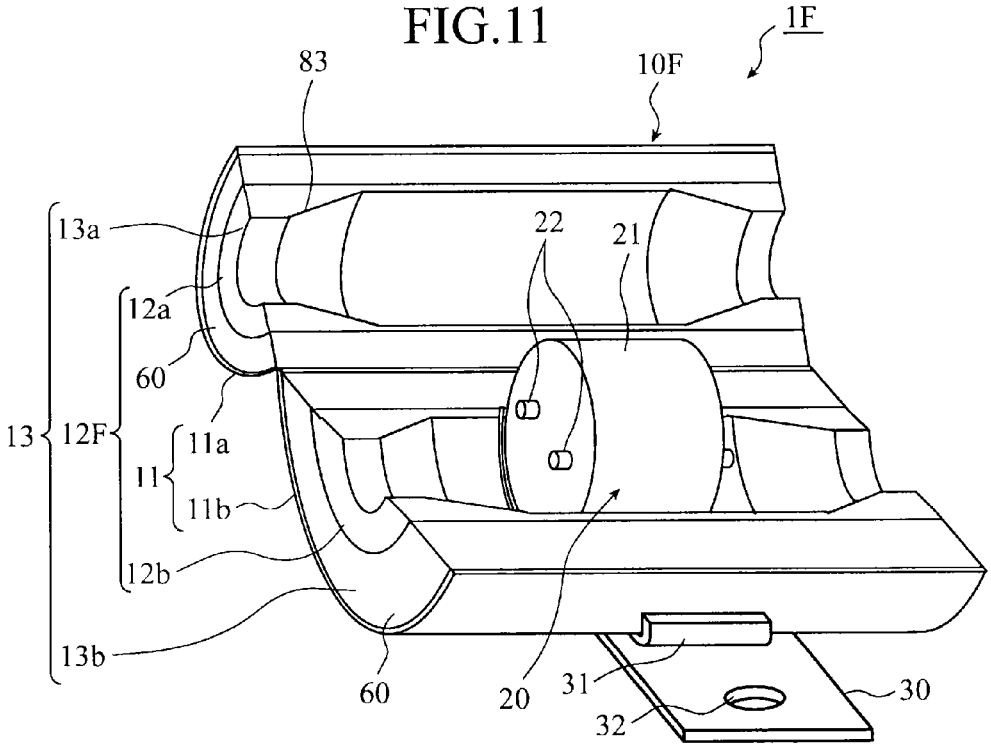
FIG. 11 is a view showing a still further example of the structure of the cable coupler in accordance with Embodiment 4 of the present invention.

FIG. 11 shows the structure of a cable coupler 1F in accordance with Embodiment 4. Structural components other than an inner conductor 12F in an external cylinder mechanism 10F of the cable coupler 1F are the same as those shown in FIG. 8.

The inner conductor 12F includes tapered shape structures formed on an inner wall thereof instead of the above-mentioned sawtooth-shaped engaging conductor 80 of the inner conductor 12C, the above-mentioned projecting and recessed portions 81 of the inner conductor 12D, or the above-mentioned flat springs 82 of the inner conductor 12E. The tapered shape structures 83 are formed at positions on the inner wall of the inner conductor 12E, particularly at positions opposite to the outer conductors 51*a* and 51*b* for shield of the shielded cables 50*a* and 50*b* (refer to FIG. 5), in such a way that the inner diameter of the cylindrical-shaped inner conductor becomes smaller along an axis direction with distance from a central portion of the inner conductor, and function as a mechanism for strengthening the electric and mechanical contact between the inner wall of the inner conductor 12F and the surfaces of the outer conductors 51*a* and 51*b* for shield.

When the shielded cables 50*a* and 50*b* are fitted into the external cylinder mechanism 10F, the tapered shape structures 83 formed on the inner wall of the inner conductor 12F cause the outer conductors 51*a* and 51*b* for shield to become deformed as if to crimp them to press down the outer conductors. When the external cylinder mechanism 10F is closed, the tapered shape structures 83 further crimp the outer conductors 51*a* and 51*b* for shield to fix them to the internal conductor. Because the tapered shape structures 83 crimp the outer conductors 51*a* and 51*b* for shield to press down them, the cable coupler 1F certainly prevents the electric and mechanical contact between the cable coupler 1F and the shielded cables 50*a* and 50*b* from being lost due to a vibration from the routes of the shielded cables 50*a* and 50*b* and a vibration from outside the cable coupler.

As mentioned above, while the cable coupler 1 (1C, 1D, 1E, or 1F) in accordance with Embodiment 4 provides the same advantages as those provided by Embodiments 1, 2 and 3, because the cable coupler 1 (1C, 1D, 1E, or 1F) in accordance with Embodiment 4 is constructed in such a way as to have conductors (the engaging conductors 80, the projecting and recessed portions 81, the flat springs 82, or the tapered shape structures 83) arranged at positions on the inner wall of the inner conductor 12 (12C, 12D, 12E, or 12F) of the external cylinder mechanism 10 (10C, 10D, 10E, or 10F) which are opposite to the outer conductors 51*a* and 51*b* for shield of the shielded cables 50*a* and 50*b* (refer to FIG. 5), for pressing down the outer conductors 51*a* and 51*b* for shield of the above-mentioned shielded cables 50*a* and 50*b*, the cable coupler 1 (1C, 1D, 1E, or 1F) provides an advantage of being able to certainly prevent the electric and mechanical contact between the cable coupler 1 (1C, 1D, 1E, or 1F) and the shielded cables 50*a* and 50*b* from being lost, thereby being able to prevent degradation of the performance of the cable coupling connector.

In Embodiment 4, although the structure in which a gap portion 13 is filled with dielectric substances 60 is explained, the cable coupler according this embodiment can have a structure using capacitors 41, like that in accordance with Embodiment 1.

Embodiment 5

In Embodiment 2, the structure in which the gap portion 13 between the outer conductor 11 and the inner conductor 12 of the external cylinder mechanism 10 of the cable coupler 1A is filled with the dielectric substances 60 (the capacitive member) for electrically connecting between the outer conductor 11 and the inner conductor 12 is explained. In Embodiment 5, a structure in which the effect of suppression of the propagation of an electromagnetism noise piggybacked onto the outer conductors 51*a* and 51*b* for shield of shielded cables 50*a* and 50*b* is enhanced in the structure in accordance with Embodiment 2 will be explained.

Figure 12:
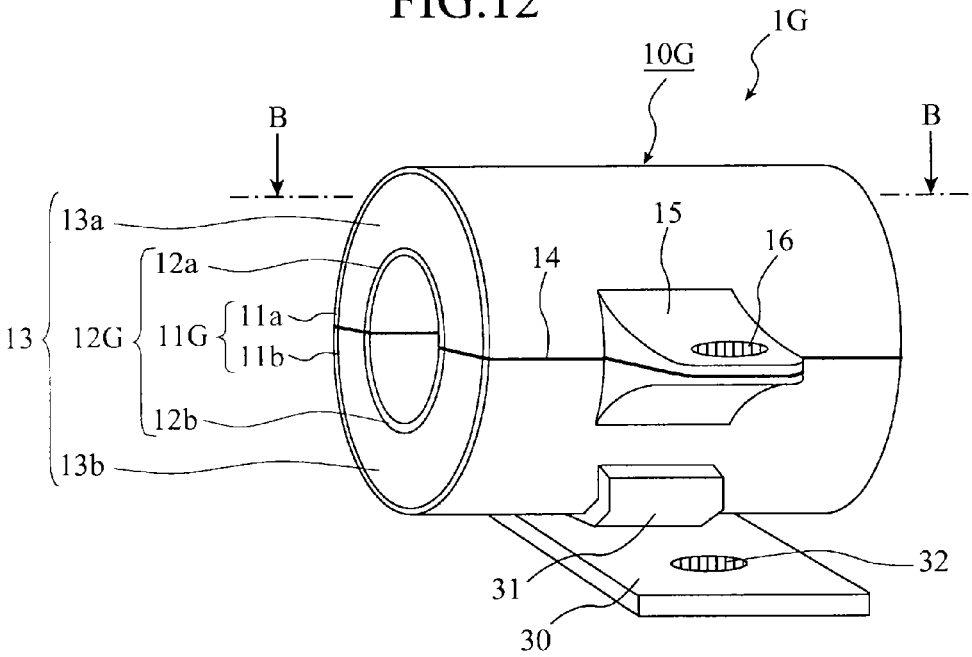
FIG. 12 is a view showing the external appearance of a cable coupler in accordance with Embodiment 5 of the present invention.
Figure 13:
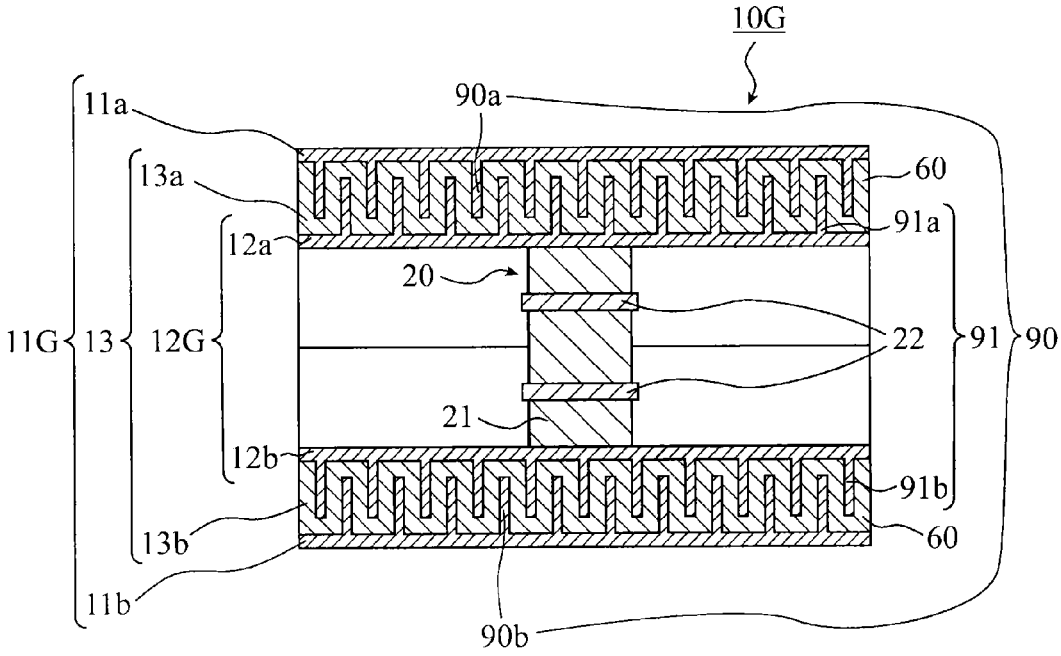
FIG. 13 is a cross-sectional view showing the structure of an external cylinder mechanism in the cable coupler in accordance with Embodiment 5 of the present invention, viewed from a direction of B of FIG. 12.

FIG. 12 shows a cable coupler 1G in accordance with Embodiment 5. Further, FIG. 13 shows a cross section taken along the B-B line of an external cylinder mechanism 10G of the cable coupler 1G shown in FIG. 12. In FIGS. 12 and 13, the structural components other than an outer conductor 11G and an inner conductor 12G of the external cylinder mechanism 10G are the same as those according to one of the above-mentioned embodiments (for example, Embodiment 2), the same components as those according to the one of the above-mentioned embodiments are designated by the same reference numerals as those shown in the embodiment, and the explanation of the components will be omitted hereafter.

The outer conductor 11G and the inner conductor 12G are placed opposite to each other, and a gap portion 13 between the outer conductor 11G and the inner conductor 12G is filled with dielectric substances 60 as a capacitive member. Each of the dielectric substances 60 has a function equivalent to that of the above-mentioned capacitors 41 shown in FIG. 3, and electrically connects between the outer conductor 11G and the inner conductor 12G.

In the outer conductor 11G, projections 90*a* are formed on an upper outer conductor 11*a*, and projections 90*b* are formed on a lower outer conductor 11*b*. In the inner conductor 12G, projections 91*a* are formed on an upper inner conductor 12*a*, and projections 91*b* are formed on a lower inner conductor 12*b*. The projections 90*a* and 90*b* of the outer conductor 11G and the projections 91*a* and 91*b* of the inner conductor 12G are arranged in such a way that the projections 90*a* and 91*a* are alternately extending opposite to each other in the gap portion 13 and the projections 90*b* and 91*b* are alternately extending opposite to each other in the gap portion 13, and these projections are shaped into teeth of a comb.

Figure 14:
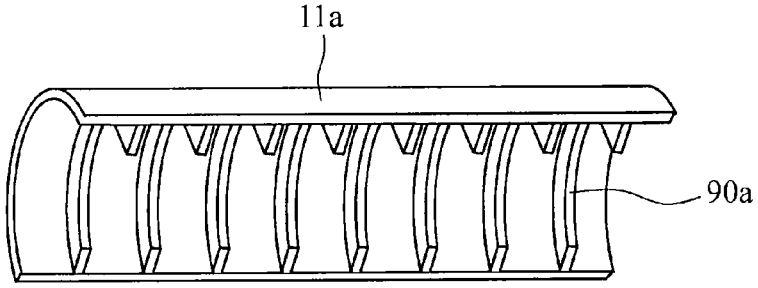
FIG. 14 is a view showing the outside shape of an outer conductor in accordance with Embodiment 5 of the present invention.

FIG. 14 shows the outside shape of the upper outer conductor 11*a* of the outer conductor 11G in the cable coupler 1G in accordance with Embodiment 5. As shown in this figure, the projections 90*a* are formed on the inner wall of the upper outer conductor 11*a* at equal intervals. The projections 90*b* are formed on the inner wall of the above-mentioned lower outer conductor 11*b* in the same way that the projections are formed on the upper outer conductor 11*a*. The outer conductor 11G consists of a combination of the upper outer conductor 11*a* and the lower outer conductor 11*b*.

Figure 15:
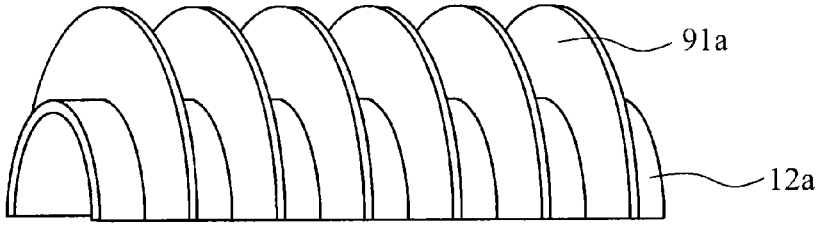
FIG. 15 is a view showing the outside shape of an inner conductor in accordance with Embodiment 5 of the present invention.

FIG. 15 shows the upper inner conductor 12*a* of the inner conductor 12G in the cable coupler 1G in accordance with Embodiment 5. As shown in this figure, the projections 91*a* are formed on the outer wall of the upper outer conductor 12*a* at equal intervals. The projections 91*b* are formed on the inner wall of the above-mentioned lower inner conductor 12*b* in the same way that the projections are formed on the upper inner conductor 12*a*. The inner conductor 12G consists of a combination of the upper inner conductor 12*a* and the lower inner conductor 12*b*.

The external cylinder mechanism 10G in accordance with Embodiment 5 is constructed by fitting the outer conductor 11G and the inner conductor 12G which are constructed in the above-mentioned way to each other to combine them, and then filling the gap between the outer conductor 11G and the inner conductors 12G with the dielectric substances 60. The projections 90 of the outer conductor 11G and the projections 91 of the inner conductor 12G can be constructed in such a way that the area of overlap of each projection 90 and a projection 91 opposite to that projection 90 increases according to their sizes.

The capacitance C of a capacitor which is formed by sandwiching a dielectric substance between two conductor plates is typically expressed by the following equation (1).

$$C=\times(S/d) \tag{1}$$

In this equation (1), ∈ is a dielectric constant which the dielectric substance 60 (the capacitive member) has, d is the distance between the two conductors, and S is the area of overlap of the two conductors opposite to each other. Therefore, it can be seen from the equation (1) that in order to increase the capacitance C of the capacitor, there are provided three different methods including a method of using a dielectric substance 60 (a capacitive member) having a high dielectric constant, a method of shortening the distance between the two conductors, and a method of increasing the area of overlap of the two conductors opposite to each other.

The method of respectively forming the projections 90 and 91 on the outer conductor 11 and on the inner conductor 12 of the external cylinder mechanism 10 in accordance with Embodiment 5 is equivalent to the method of increasing the area of overlap of the two conductors opposite to each other among the above-mentioned three different methods.

Therefore, because the structure of the cable coupler 1G in accordance with Embodiment 5 makes it possible to provide a larger capacitance even in the case of using the same material as the dielectric substances 60 (the capacitive member) which is used in Embodiment 2, the propagation suppression for various electromagnetism noises can be achieved.

Because a connection method of connecting the shielded cables by using the cable coupler 1G is the same as that in accordance with Embodiment 1, the explanation of the connection method will be omitted hereafter.

As mentioned above, while the cable coupler 1G in accordance with Embodiment 5 provides the same advantages as those provided by Embodiments 1 and 2, because the cable coupler 1G in accordance with Embodiment 5 is constructed in such a way as to include the projections 90 formed on the inner wall of the outer conductor 11G of the external cylinder mechanism 10G and shaped like teeth of a comb, and the projections 91 formed on the outer wall of the inner conductor 12G of the external cylinder mechanism 10G and shaped like teeth of a comb, the projections formed on the inner wall and the projections formed on the inner wall alternately extending in directions opposite to each other, the cable coupler 1G in accordance with Embodiment 5 provides an advantage of being able to adjust the capacitance which the cable coupler 1G has by filling the gap portion 13 formed by the projections 90 formed on the outer conductor 11G and the projections 91 formed on the inner conductor 12G in the external cylinder mechanism 10G of the cable coupler 1G with the dielectric substances 60 for electrically connecting between the outer conductor 11G and the inner conductor 12G. As a result, there is provided an advantage of being able to enhance the effect of the suppression of the propagation of an electromagnetism noise piggybacked onto the outer conductors 51*a* and 51*b* for shield of the shielded cables 50*a* and 50*b* (refer to FIG. 5).

Figure 16:
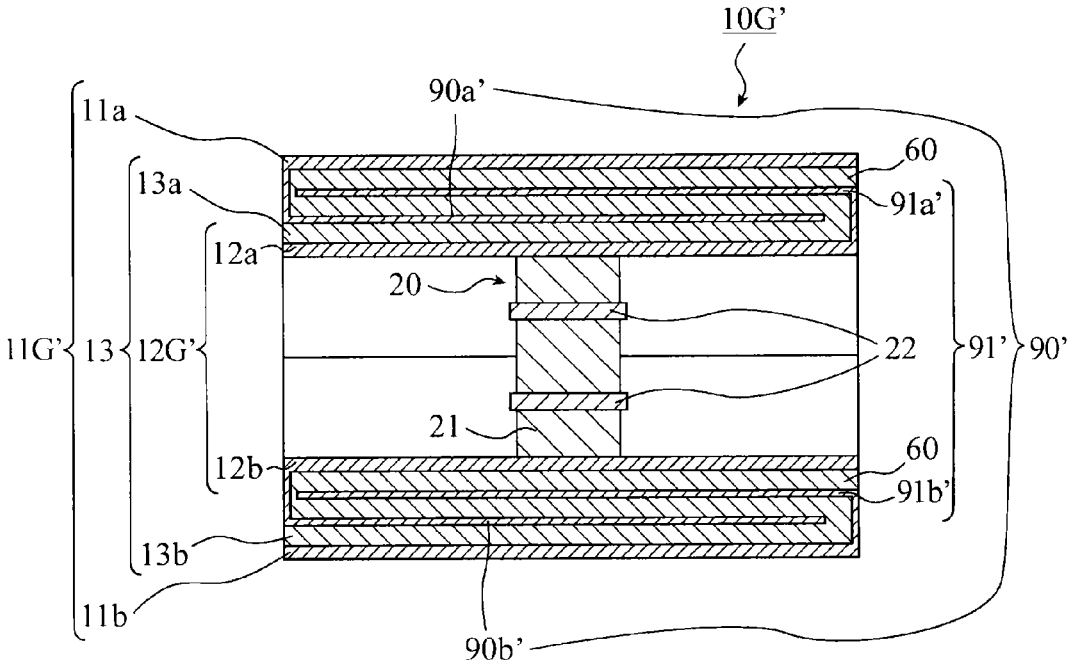
FIG. 16 is a view showing a cross section of another example of the external cylinder mechanism in the cable coupler in accordance with Embodiment 5 of the present invention.

In this embodiment, the directions in which the projections 90 and 91 are respectively extending on the outer conductor 11G and on the inner conductor 12G of the external cylinder mechanism 10G are not limited to vertical directions as shown in FIG. 13. For example, the cable coupler can alternatively have such a structure as shown in FIG. 16 in which projections are extending in horizontal directions. In this case, the same advantages are provided. In this case, in an outer conductor 11G' of an external cylinder mechanism 10G', a projection 90*a*' is formed on an upper outer conductor 11*a* and a projection 90*b*' is formed on a lower outer conductor 11*b*. In an inner conductor 12G' of the external cylinder mechanism, a projections 91*a*' is formed on an upper inner conductor 12*a* and a projection 91*b*' is formed on a lower inner conductor 12*b*. The projections 90*a*□L and 90*b*□L of the outer conductor 11G□L and the projections 91*a*□L and 91*b*□L of the inner conductor 12G' are formed in such a way that each projection formed on the outer conductor and a corresponding projection formed on the inner conductor are alternately extending opposite to each other in parallel with a longitudinal direction.

Embodiment 6

In Embodiment 5, the structure for adjusting the capacitance which the cable coupler 1G has is explained. In Embodiment 6, another structure for enhancing the effect of the suppression of the propagation of an electromagnetism noise piggybacked onto the outer conductors 51*a* and 51*b* for shield of shielded cables 50*a* and 50*b* will be explained.

Figure 17:
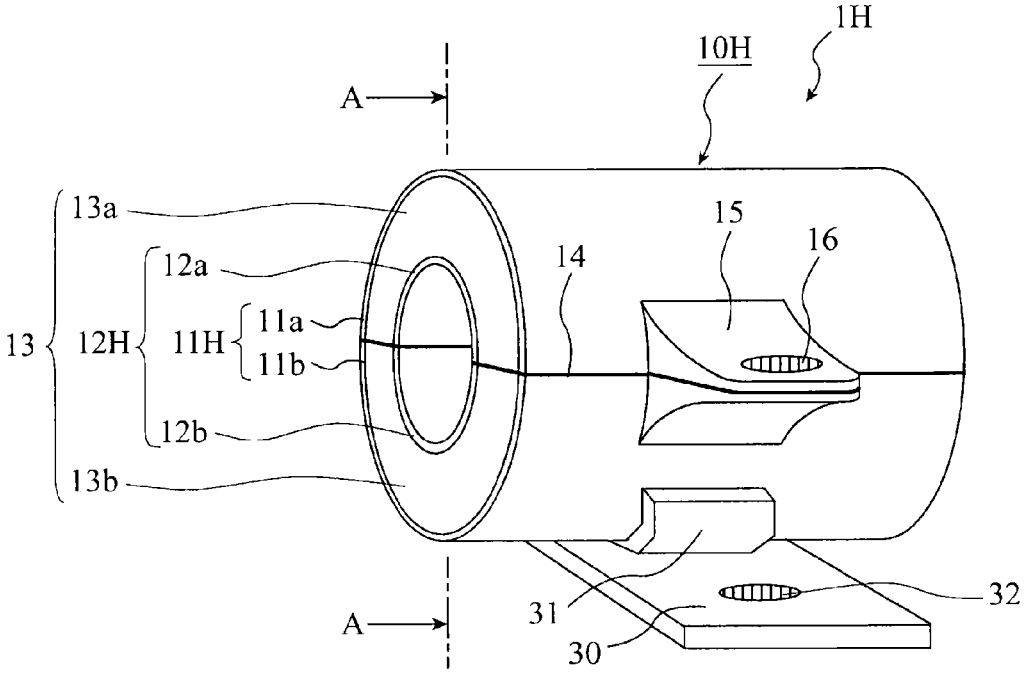
FIG. 17 is a view showing the external appearance of a cable coupler in accordance with Embodiment 6 of the present invention.
Figure 18:
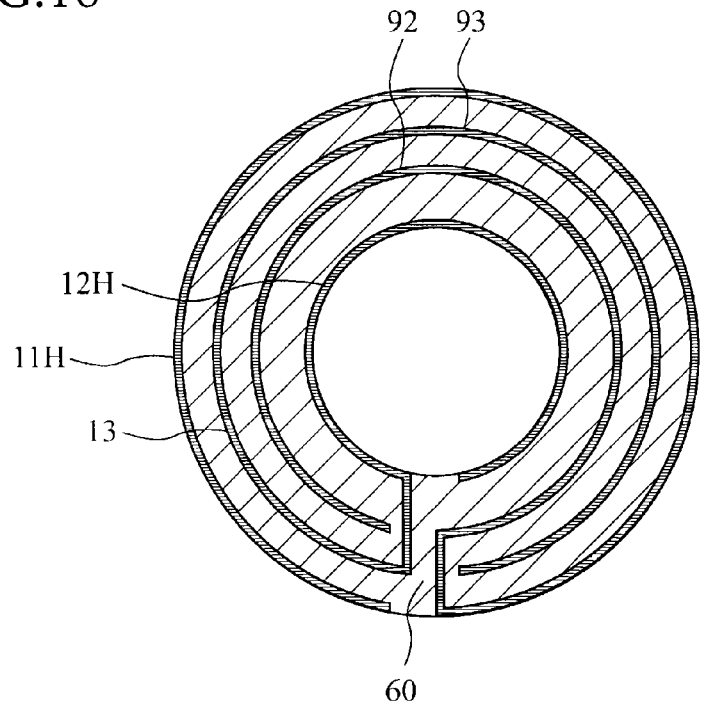
FIG. 18 is a cross-sectional view showing the structure of a cable coupler in accordance with Embodiment 6 of the present invention, viewed from a direction of A of FIG. 17.

FIG. 17 shows a cable coupler 1H in accordance with Embodiment 6. FIG. 18 shows a cross section taken along the A-A line of an external cylinder mechanism 10H of the cable coupler 1H shown in FIG. 17. In FIGS. 17 and 18, the structural components other than an outer conductor 11H and an inner conductor 12H of the external cylinder mechanism 10H are the same as those according to one of the above-mentioned embodiments, the same components as those according to the one of the above-mentioned embodiments are designated by the same reference numerals as those shown in the embodiment, and the explanation of the components will be omitted hereafter.

The outer conductor 11H and the inner conductor 12H are placed opposite to each other, and a gap portion 13 between the outer conductor 11H and the inner conductor 12H is filled with dielectric substances 60 as a capacitive member. Each of the dielectric substances 60 has a function equivalent to that of the above-mentioned capacitors 41 shown in FIG. 3, and electrically connects between the outer conductor 11H and the inner conductor 12H.

As shown in FIG. 18, a roll portion 92 is formed in the outer conductor 11H, and a roll portion 93 is formed in the inner conductor 12H. The roll portion 92 of the outer conductor 11H and the roll portion 93 of the inner conductor 12H are formed into a bent and roll-formed shape in such a way that they are opposite to each other. The gap portion 13 between the roll portion 92 of the outer conductor 11H and the roll portion 93 of the inner conductor 12H is filled with the dielectric substances (the capacitive member) 60.

Because the roll portion 92 of the outer conductor 11H and the roll portion 93 of the inner conductor 12H are thus arranged in such a way that they are opposite to each other in a roll-formed shape, the cable coupler in accordance with this embodiment is constructed in such a way as that the area of overlap of the outer conductor 11H and the inner conductor 12H opposite to each other becomes large, and the capacitance which the external cylinder mechanism 10H has increases even in the case of using the same material as the dielectric substances 60 (the capacitive member) which are used in Embodiment 2, like in the case of Embodiment 5.

As mentioned above, because in the external cylinder mechanism 10H of the cable coupler 1H in accordance with Embodiment 6, the roll portion 92 of the outer conductor 11H and the roll portion 93 of the inner conductor 12H are arranged in a roll-formed shape in such a way that they are opposite to each other, and the dielectric substances (the capacitive member) 60 are placed between the roll portion 92 of the outer conductor 11H and the roll portion 93 of the inner conductor 12H which are arranged in the above-mentioned rolled form, the area of overlap of the outer conductor 11H and the inner conductor 12H opposite to each other can be increased, and therefore the capacitance which the external cylinder mechanism 10H has can be increased. As a result, the cable coupler 1H provides an advantage of being able to achieve propagation suppression for various electromagnetism noises, and to enhance the effect of the suppression of the propagation of an electromagnetism noise piggybacked onto the outer conductors 51*a* and 51*b* for shield of the shielded cables 50*a* and 50*b* (refer to FIG. 5).

Embodiment 7

In each of Embodiments 5 and 6, the structure for increasing the capacitance which the external cylinder mechanism (10G or 10H) has by changing the shapes of the outer conductor (11G or 11H) and the inner conductor (12G or 12H) of the external cylinder mechanism (10G or 10H) is explained. In addition, in Embodiment 7, another example of the structure for enhancing the effect of the suppression of the propagation of an electromagnetism noise piggybacked onto the outer conductors 51*a* and 51*b* for shield of shielded cables 50*a* and 50*b* will be explained.

Figure 19:
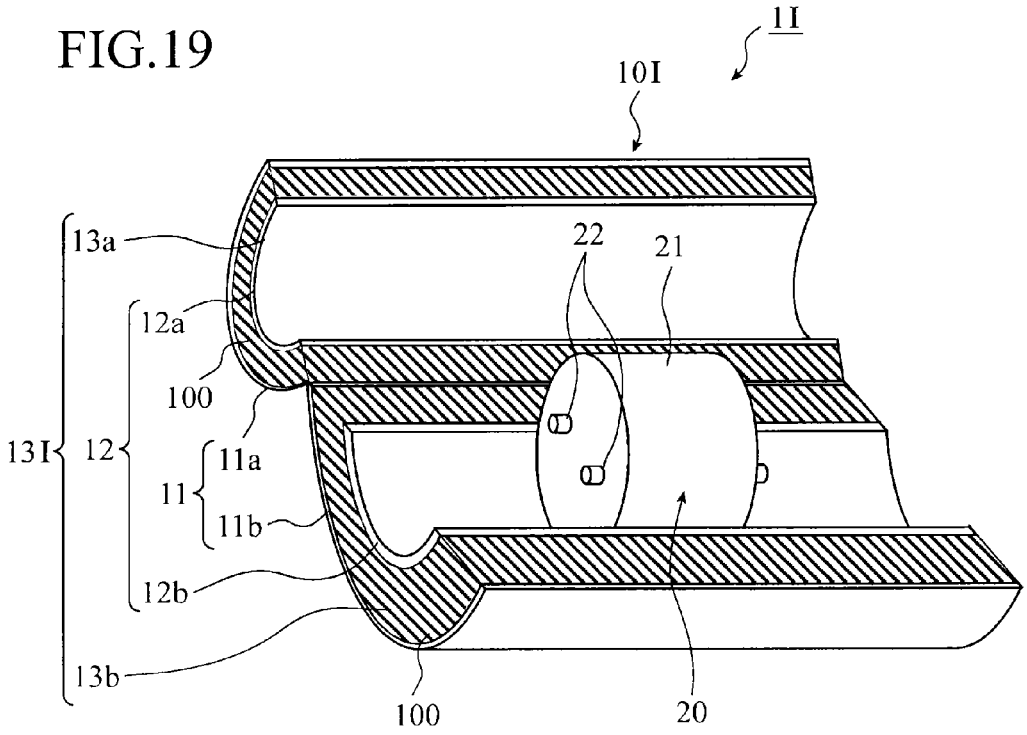
FIG. 19 is a view showing the structure of a cable coupler in accordance with Embodiment 7 of the present invention.

FIG. 19 is a view showing the structure of a cable coupler 1I in accordance with Embodiment 7. In the cable coupler 1I of FIG. 19, because the structural components other than a gap portion 13I of an external cylinder mechanism 10I are the same as those according one of the above-mentioned embodiments (particularly, Embodiments 1 and 2), the components other than the gap portion 13I are designated by the same reference numerals as those shown in the embodiment, and the explanation of the components will be omitted hereafter.

The gap portion 13I of the external cylinder mechanism 10I is filled with magnetic substances 100 (an inductive member) instead of the capacitors 41 or the dielectric substances 60 disposed as the above-mentioned capacitive member.

Because the external cylinder mechanism 10I is thus constructed in such a way that the magnetic substances (the inductive member) 100 are placed in the gap portion 13I between an outer conductor 11 and an inner conductor 12, the external cylinder mechanism constructs an inductor which is equivalently connected in series to the outer conductors 51*a* and 51*b* for shield of the shielded cables 50*a* and 50*b* as shown in above-mentioned FIG. 5 (refer to FIG. 5).

Because the propagation path of an electromagnetism noise piggybacked onto the outer conductors 51*a* and 51*b* for shield is in a state in which its impedance is high because of the inductor equivalently connected in series to the outer conductors resulting from the magnetic substances 100 (the inductive member) added to the portion surrounding the inner conductor 12 of the external cylinder mechanism 10I, no large electromagnetism noise can pass the cable coupler 1I, and the propagation of the noise is suppressed as a result. The impedance resulting from the inductor connected in series to the outer conductors is given by the following equation (2), and it can be seen from this equation that the impedance increases according to the self-inductance which the inductor has as the frequency increases.

$$Z=\omega\times L \tag{2}$$

In the above-mentioned equation (2), Z is the impedance of the inductor, ω is the angular frequency of a signal passing the inductor, and L is the self-inductance which the inductor has.

Figure 20:
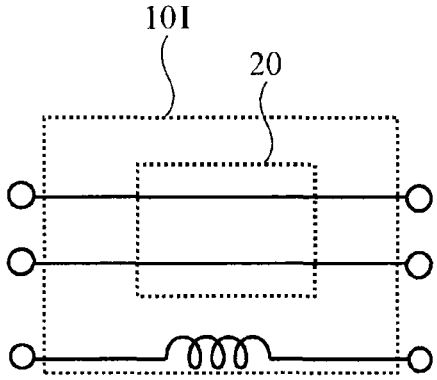
FIG. 20 is a view showing an equivalent circuit of the cable coupler in accordance with Embodiment 7 of the present invention.

In addition, it is known that the magnetic substances (the inductive member) 100 typically have a high dielectric constant (about 12.0 to 16.0 in the case of ferrite (Fe2O3)), the magnetic substances (the inductive member) 100 with which the gap portion 13I is filled can also provide the same advantage as that provided in the case of filling the gap portion with the dielectric substances (the capacitive member) 60 simultaneously. Therefore, because an equivalent circuit as shown in FIG. 20 is formed in the cable coupler 1I, this cable coupler can provide both the noise suppression effect using capacitor and the noise suppression effect using inductor.

As mentioned above, because the external cylinder mechanism 10I in the cable coupler 1I in accordance with Embodiment 7 is constructed in such a way that the gap portion 13I between the outer conductor 11 and the inner conductor 12 of the external cylinder mechanism 10I is filled with the magnetic substances (the inductive member) 100 disposed as the capacitive member, the cable coupler 1I can provide both the noise suppression effect using capacitor and the noise suppression effect using inductor. As a result, there is provided an advantage of being able to suppress the propagation of an electromagnetism noise flowing into the outer conductors 51*a* and 51*b* for shield of the shielded cables 50*a* and 50*b*.

Typically, ferrite or permalloy (a sintered magnetic substance) is used as each of the magnetic substances (the inductive member) 100 with which the gap portion is filled. Because each of these materials is sintered and composed in many cases, the produced magnetic substances have a characteristic of being very firm. Therefore, as each of the magnetic substances (the inductive member) 100, a resin into which a magnetic substance powder is mixed can be used instead of a sintered material. The use of a resin into which a magnetic substance powder having a flexible characteristic is mixed can not only increase the flexibility of the shape of the external cylinder mechanism 1 but also simplify the process of forming the external cylinder mechanism 1.

Embodiment 8

In Embodiment 7, the structure in which the gap portion 13I is filled with the magnetic substances (the inductive member) 100 is explained. In Embodiment 8, a structure for enhancing the effect of the suppression of the propagation of an electromagnetism noise piggybacked onto the outer conductors 51*a* and 51*b* for shield of shielded cables 50*a* and 50*b* with a combination of a dielectric substance and a magnetic substance will be explained.

Figure 21:
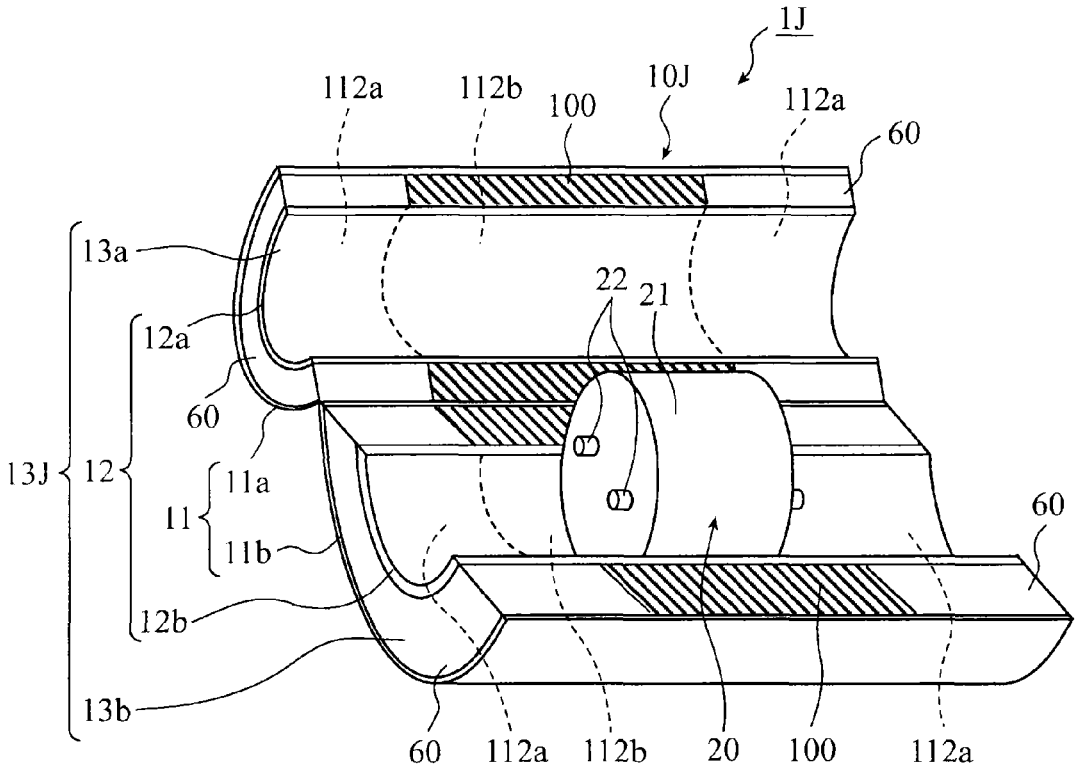
FIG. 21 is a view showing the structure of a cable coupler in accordance with Embodiment 8 of the present invention.

FIG. 21 shows the structure of a cable coupler 1J in accordance with Embodiment 8. In the cable coupler 1J shown in FIG. 21, because the structural components other than a gap portion 13J of an external cylinder mechanism 10J are the same as those according one of the above-mentioned embodiments, the components other than the gap portion 13J are designated by the same reference numerals as those shown in the embodiment, and the explanation of the components will be omitted hereafter.

Figure 22:
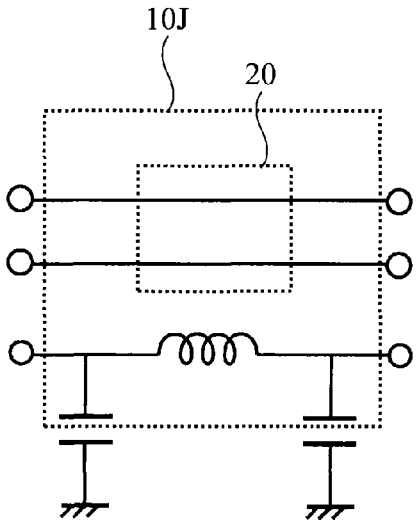
FIG. 22 is a view showing an equivalent circuit of the cable coupler in accordance with Embodiment 8 of the present invention.

On the basis of boundaries on an inner wall of an inner conductor 12 between both end portions 112*a* thereof in contact with the outer conductors 51*a* and 51*b* for shield of the shielded cables 50*a* and 50*b* shown in above-mentioned FIG. 5, and a central portion 112*b* which is not in contact with the outer conductors, a corresponding central portion of the gap portion 13J of the external cylinder mechanism 10J is filled with a magnetic substance 100, and each of both corresponding end portions of the gap portion 13J is filled with a dielectric substance 60. Because the gap portion is constructed in this way, a structure equivalent to a capacitor is formed in each of both the end portions of the cable coupler 1J and a structure equivalent to an inductor is simultaneously formed in the central portion of the cable coupler 1J. Because these circuit elements equivalent to capacitors and equivalent to an inductor are combined in this way, the cable coupler 1J can serve as an equivalent circuit as shown in FIG. 22 and form a n-type LC filter.

Figure 23:
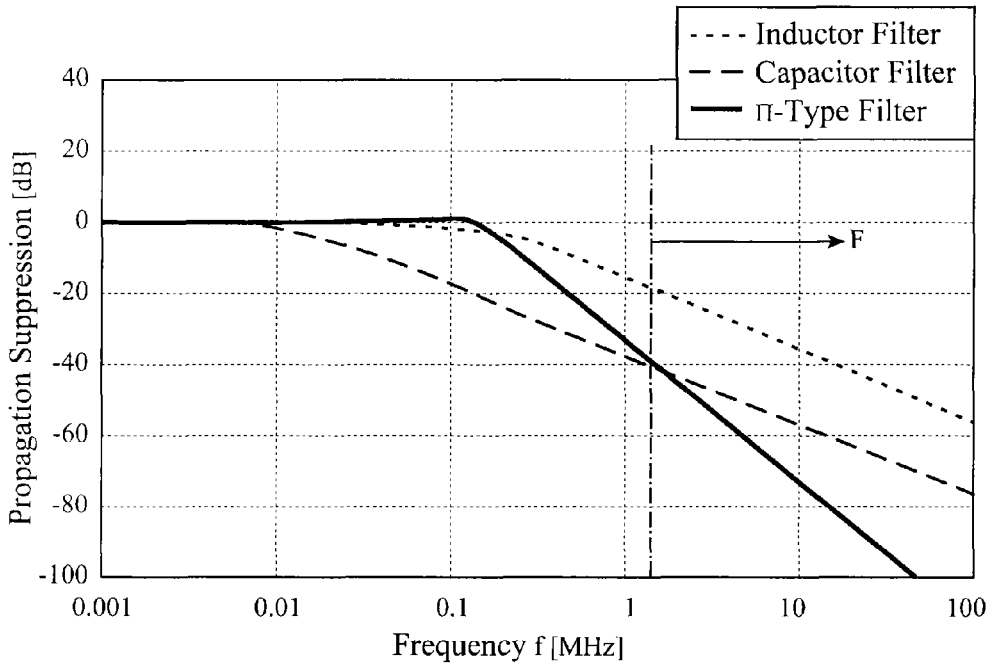
FIG. 23 is a view showing a comparison among the propagation operating characteristics of filters for use in the cable coupler in accordance with Embodiment 8 of the present invention.

FIG. 23 shows a comparison among the propagation operating characteristics of a n-type filter, an inductor filter, and a capacitor filter. It can be seen from FIG. 23 that in a band in which the frequency of a target electromagnetism noise is higher than F shown in FIG. 23, the propagation suppression effect of the n-type filter is greater than those of the inductor filter and the capacitor filter, and the n-type filter is more effective to an electromagnetism noise whose frequencies are biased toward high values.

As mentioned above, because the external cylinder mechanism 10J in the cable coupler 1J in accordance with Embodiment 8 is constructed in such a way that the dielectric substance (the capacitive member) 60 is placed in each part, which corresponds to a portion where the outer conductor 51 for shield of the shielded cable 50 is in contact with the inner conductor 12, of the gap portion 13J between the outer conductor 11 and the inner conductor 12 of the external cylinder mechanism 10J, and the magnetic substance (the inductive member) 100 is placed in the part, which corresponds to the portion where the outer conductors 51*a* and 51*b* (refer to FIG. 5) for shield of the shielded cables 50*a* and 50*b* are not in contact with the inner conductor 12, of the gap portion 13J, circuit elements equivalent to capacitors and equivalent to an inductor are combined, and therefore a n-type LC filter can be formed in the cable coupler. As a result, the cable coupler 1J provides an advantage of being able to greatly suppress the propagation of an electromagnetism noise flowing via the outer conductors 51*a* and 51*b* for shield of the shielded cables 50*a* and 50*b* and having frequency components biased toward high frequencies.

Further, in the cable coupler 1J in accordance with Embodiment 8, even though the part of the outer conductor 11 corresponding to the part of the gap portion which is filled with the magnetic substance (the inductive member) 100 is chipped, there is no difference in the advantages provided. Therefore, also in a case in which there is a necessity to separate the grounding of the outer conductor 11 for the shielded cable 50*a* from that for the shielded cable 50*b* to handle them for convenience' sake at the time of mounting the cable coupler, the cable coupler can be applied without changing its structure greatly.

The cable coupler in accordance with any one of the embodiments functions as a cable coupling connector, and is handled as a unit having the same characteristics.

INDUSTRIAL APPLICABILITY

As mentioned above, the cable coupler in accordance with the present invention is suitable for use as a cable coupling connector for connecting between two shielded cables included in various types of shielded cables.

The invention claimed is:

1. A cable coupling connector comprising:

an external cylinder mechanism having an inner conductor electrically connected to outer conductors of shielded cables throughout entire perimeters of the outer conductors and having a space formed therein, an outer conductor formed outside said inner conductor, and a capacitive member placed in a gap portion between said inner conductor and said outer conductor and having a property of electrically insulating the outer conductor and the inner conductor from each other with respect to a direct current, and electrically connecting between said outer conductor and said inner conductor with respect to an alternating current, said external cylinder mechanism being formed in such a way that an inner portion of said external cylinder mechanism can be opened and closed along a longitudinal direction of said inner conductor and said outer conductor;

an internal coupling mechanism having an isolator placed in the space of the inner conductor of said external cylinder mechanism, and connecting pins held by said isolator and electrically connecting between core wires of said shielded cables; and a base for holding said external cylinder mechanism and for electrically connecting said external cylinder mechanism to an external conductor.

2. The cable coupling connector according to claim 1, wherein said capacitive member is a capacitor.

3. The cable coupling connector according to claim 1, wherein said capacitive member is a dielectric substance.

4. The cable coupling connector according to claim 1, wherein said cable coupling connector has a guide portion disposed on an inner wall of the inner conductor of said external cylinder mechanism, for positioning said internal coupling mechanism.

5. The cable coupling connector according to claim 1, wherein each of said connecting pins includes spring members for holding a core wire of a shielded cable by sandwiching the core wire therebetween.

6. The cable coupling connector according to claim 1, wherein each of said connecting pins includes swage parts for holding a core wire of a shielded cable by allowing the swage parts themselves to be swaged to crimp and fix the core wire.

7. The cable coupling connector according to claim 1, wherein said cable coupling connector has conductors respectively placed on inner walls of the inner conductor of said external cylinder mechanism, said inner walls being respectively opposite to the outer conductors of said shielded cables, for pressing down the outer conductors of said shielded cables.

8. The cable coupling connector according to claim 7, wherein the conductors for pressing down the outer conductors of said shielded cables are sawtooth-shaped engaging conductors.

9. The cable coupling connector according to claim 7, wherein the conductors for pressing down the outer conductors of said shielded cables are projecting and recessed portions.

10. The cable coupling connector according to claim 7, wherein the conductors for pressing down the outer conductors of said shielded cables are flat springs.

11. The cable coupling connector according to claim 7, wherein the conductors for pressing down the outer conductors of said shielded cables are tapered shape structures.

12. The cable coupling connector according to claim 1, wherein said cable coupling connector has projections formed on an inner wall of the outer conductor of said external cylinder mechanism and shaped like teeth of a comb, and projections formed on an outer wall of the inner conductor of said external cylinder mechanism and shaped like teeth of a comb, said projections formed on the inner wall and said projections formed on the inner wall alternately extending in directions opposite to each other.

13. The cable coupling connector according to claim 1, wherein said cable coupling connector has a projection formed on an inner wall of the outer conductor of said external cylinder mechanism and a projection formed on an outer wall of the inner conductor of said external cylinder mechanism, said projection formed on the inner wall and said projection formed on the inner wall alternately extending in parallel with a longitudinal direction.

14. The cable coupling connector according to claim 1, wherein in said external cylinder mechanism, said outer conductor and said inner conductor are arranged in a roll-formed shape in such a way that they are opposite to each other.

15. The cable coupling connector according to claim 1, wherein an inductive member is used as the capacitive member disposed in the gap portion of said external cylinder mechanism.

16. The cable coupling connector according to claim 15, wherein said inductive member is a magnetic substance.

17. The cable coupling connector according to claim 15, wherein said inductive member is a magnetic substance powder mixed resin.

18. The cable coupling connector according to claim 1, wherein the capacitive member is placed in each of portions where the outer conductors of said shielded cables are in contact with said inner conductor in the gap portion between the inner conductor and the outer conductor of said external cylinder mechanism, and an inductive member is placed in a portion where the outer conductors of said shielded cables are not in contact with said inner conductor in the gap portion.

* * * * *